US007126561B2

(12) United States Patent
Lim

(10) Patent No.: US 7,126,561 B2
(45) Date of Patent: Oct. 24, 2006

(54) DEVICE AND METHOD FOR DRIVING PLASMA DISPLAY PANEL

(75) Inventor: Geun Soo Lim, Songnam-shi (KR)

(73) Assignee: LG Electronics Inc., Seoul (KR)

( * ) Notice: Subject to any disclaimer, the term of this patent is extended or adjusted under 35 U.S.C. 154(b) by 158 days.

(21) Appl. No.: 10/091,353

(22) Filed: Mar. 6, 2002

(65) Prior Publication Data

US 2002/0158821 A1 Oct. 31, 2002

(30) Foreign Application Priority Data

Mar. 7, 2001 (KR) ..... 2001-11740

(51) Int. Cl.
*G09G 3/28* (2006.01)

(52) U.S. Cl. ..... 345/60

(58) Field of Classification Search ..... 345/60, 345/61, 66, 67

See application file for complete search history.

(56) References Cited

U.S. PATENT DOCUMENTS 5,446,344 A * 8/1995 Kanazawa ..... 315/169.4
6,262,699 B1 * 7/2001 Suzuki et al. ..... 345/68
6,340,960 B1 * 1/2002 Song et al. ..... 345/60
6,407,510 B1 * 6/2002 Yoo et al. ..... 315/169.4
6,603,449 B1 * 8/2003 Kang et al. ..... 345/67

* cited by examiner

*Primary Examiner*—Jimmy H Nguyen
(74) *Attorney, Agent, or Firm*—Fleshner & Kim, LLP

(57) ABSTRACT

Device and method for driving a plasma display panel, wherein scanning pulses are progressively applied to the plurality of scanning/sustain electrode lines divided and driving in two or more than two blocks such that the scanning pulses are overlapped to each other, and first data pulses each with a first logic value and second data pulses each with a second logic value each having a data pulse width different from the first data pulse, are progressively applied to the plurality of address electrode lines, for causing address discharges at the plurality of discharge cells selectively, thereby permitting fast addressing, and minimizing power consumption.

15 Claims, 9 Drawing Sheets

DEVICE AND METHOD FOR DRIVING PLASMA DISPLAY PANEL

This application claims the benefit of the Korean Application No. P2001-11740 filed on Mar. 7, 2001, which is hereby incorporated by reference.

BACKGROUND OF THE INVENTION

1. Field of the Invention

The present invention relates to device and method for driving a plasma display panel, and more particularly to device and method for driving a plasma display panel, which permits fast addressing, and minimizes power consumption.

2. Background of the Related Art

The plasma display panel (hereafter called as 'PDP') is a display using a visible light emitted from a fluorescent material excited by a UV ray generated by gaseous discharge. The PDP has advantages in that the PDP is thinner and lighter than a cathode ray tube (CRT) that has been major displaying means up to now, and facilitates a large sized high resolution picture.

FIG. 1 illustrates a perspective view of a discharge cell of a related art 3 polar AC surface discharge type PDP.

Referring to FIG. 1, the discharge cell is provided with scanning/sustaining electrodes 12Y and common sustaining electrode 12Z on a bottom of an upper substrate 10, and an address electrode 20X formed on a lower substrate 18 perpendicular to the scanning/sustaining electrodes 12Y and common sustaining electrode 12Z.

There are an upper dielectric layer 14 and a protection film 16 stacked under the scanning/sustaining electrodes 12Y and common sustaining electrode 12Z formed parallel to each other of the upper substrate 10. The upper dielectric layer 14 accumulates wall charges generated at a time of plasma discharge, and the protection film 16 formed of, in general, MgO prevents the upper dielectric layer 14 suffering from damage caused by sputtering of the plasma discharge, and enhances a secondary electron emission efficiency.

There are a lower dielectric layer 22, a barrier 24 on the lower substrate 18 having the address electrode 20X formed thereon, and there is the fluorescent material 26 coated on surfaces of the lower dielectric layer 22 and the barrier 24. The barrier 24 is parallel to the address electrode 20X for preventing the UV ray and the visible light from leaking to adjacent discharge cells, and the fluorescent material 26 is excited by the UV ray emitted at the time of plasma discharge, to emit one of visible lights of red, green, and blue. There is an inert gas injected in a discharge space between the barriers for gaseous discharge.

FIG. 2 illustrates electrode arrangement of a PDP having the discharge cell in FIG. 1.

Referring to FIG. 2, the discharge cells, arranged in a form of a matrix, are formed at crossing parts of scanning/sustaining electrode lines Y1–Ym, common sustaining electrode lines Z1–Zm, and address electrode lines X1–Xn.

A PDP driving device for driving the discharge cells is provided with a scanning/sustaining electrode driving part for driving the scanning/sustaining electrode lines Y1–Ym, a common sustaining electrode driving part for driving the common sustaining electrode lines Z1–Zm, and an address electrode driving part for driving the address electrode lines X1–Xn.

The scanning/sustaining electrode lines Y1–Ym are driven progressively, the common sustaining electrode lines Z1–Zm are driven in common, and the address electrode lines X1–Xn are driven divided into odd numbered lines and even numbered lines.

The 3 polar AC surface discharge type PDP divides one frame into a plurality of sub-fields having different number of discharges for expressing gray levels of a picture. For an example, when it is intended to display a picture of 256 gray levels by using 8 bit video data, one frame period (about 16.7msec) corresponding to 1/60 seconds is divided into 8 sub-fields (SF1–SF8) as shown in FIG. 3.

Each of the 8 sub-fields (SF1–SF8) is divided into a reset period, an address period, and a sustain period, wherein while the reset period and the address period are identical for all the sub-fields, the sustain period increases at a ratio of 1:2:4:8: . . . 128 for the sub-fields. The reset period is a period for initializing the discharge cell, the address period is a period for scanning whole screen progressively and writing a data, and the sustain period is a period for sustaining light emitting states of the cells having the data written thereon.

FIG. 4 illustrates waveforms of a related art method for driving a PDP.

Referring to FIG. 4, after all the discharge cells are initialized by discharge in the reset period (not shown), scanning pulses SP are applied to the scanning/sustaining electrode lines Y1–Ym progressively in the address period, and data pulses DP synchronous to the scanning pulses SP are supplied to the address electrode lines X1–Xn.

In this instance, the common sustaining electrode lines Z1–Zm have a preset level of DC voltage supplied thereto, for stable causing stable address discharge between the address electrode lines X1–Xn and scanning/sustain electrode lines Y1–Ym.

Then, in the sustain period, the scanning/sustain electrode lines Y1–Ym and the common sustaining electrode lines Z1–Zm have sustain pulses SUSPy and SUSPz supplied thereto alternately, for light emission of the discharge cells selected during the address period.

However, if the address period is prolonged, the sustain period becomes very short to drop a luminance in a high definition PDP that has an increased number of scanning/sustain electrode lines Y.

If widths of the scanning pulses and the data pulses are reduced for making the address period short, there can be miss-writing and mal-discharge because an adequate discharge current can not flow to the scanning/sustain electrode lines Y1–Ym the scanning pulses are applied thereto.

In order to solve such a problem, a driving waveform is suggested, which uses the address driving part for generating main data pulses and supplementary data pulses. A related art driving waveform in FIG. 5 will be explained.

When a main data pulse MDP is applied to a plurality of adjacent discharge cells, one supplementary data pulse ADP having a width Tad smaller than a width Td of the main data pulse MDP is applied to parts between the main data pulses MDP as shown in FIG. 5 'A'. When any one of the discharge cells has the main data pulse applied thereto, the supplementary data pulses ADP are applied to parts in front and rear of the main data pulse MDP as shown in FIG. 5 'B' and 'C'. When no main data pulse is applied to the discharge cell, no supplementary data pulse ADP is applied.

The scanning pulse Vs progressively applied to the scanning/sustain electrode lines has a main scanning pulse MSP with a width (Tad+Td=Ts) of the main data pulse MDP and the supplementary data pulse ADP, and a supplementary scanning pulse with a width (Tad=Tas) of the supplementary data pulse ADP.

At the end, the driving waveform provides an effect of a prolonged address discharge period because the address discharge is occurred for Tad+Td+Tad time period at the discharge cell the main data pulse MDP is supplied thereto, and can reduce the address time period as much as the scanning pulses Vs supplied to the scanning/sustain electrode line Y are overlapped with each other for a preset time period.

However, the address driving part that supplies both the main data pulse MDP and the supplementary data pulse ADP has an increased power consumption as the two data pulses MDP and ADP are generated, independently.

SUMMARY OF THE INVENTION

Accordingly, the present invention is directed to device and method for driving a plasma display panel that substantially obviates one or more of the problems due to limitations and disadvantages of the related art.

An object of the present invention is to provide device and method for driving a plasma display panel, which permits a fast addressing and minimizes a power consumption.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for driving a plasma display panel having a matrix of a plurality of discharge cells formed by a plurality of scanning/sustain electrode lines and a common sustain electrode line in parallel, and a plurality of address electrode lines crossed with the scanning/sustain electrode lines and the common sustain electrode line, includes the steps of (a) discharging, and initializing the plurality of discharge cells (b) progressively applying scanning pulses to the plurality of scanning/sustain electrode lines, and progressively applying first data pulses each with a first logic value and second data pulses each with a second logic value each having a data pulse width different from the first data pulse, to the plurality of address electrode lines, for causing address discharges at the plurality of discharge cells, selectively, and (c) applying sustain pulses to the plurality of scanning/sustain electrode lines and the common sustain electrode line, for sustaining discharge at the discharge cells having the address occurred for a preset time period.

In another aspect of the present invention, there is provided a device for driving a plasma display panel having a scanning/sustain electrode driving part for driving scanning/sustain electrode lines, a common sustain electrode driving part for driving a common sustain electrode line, and an address electrode driving part for driving address electrode lines, wherein the address electrode driving part includes data receiving means for receiving a video data, memories for receiving the video data from the data receiving means and storing the video data temporarily, a control signal generating part for receiving the video data stored in the memories and generating a control signal, and forwarding means for providing a data pulse to the address electrode line in response to the control signal from the control signal generating part.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
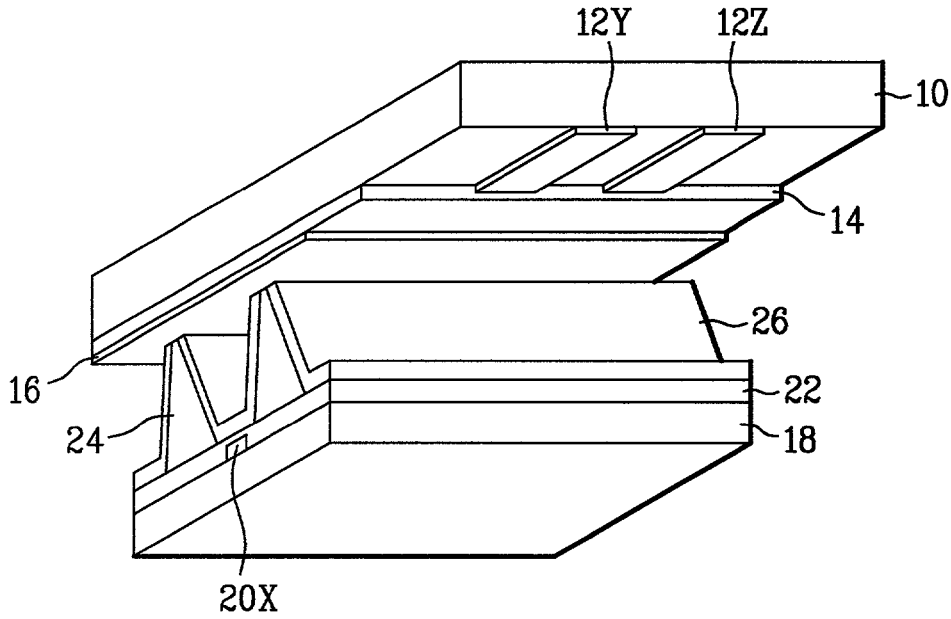
FIG. 1 Related Art
FIG. 1 illustrates a perspective view of a discharge cell of a related art 3 polar AC surface discharge type PDP.
Figure 2:
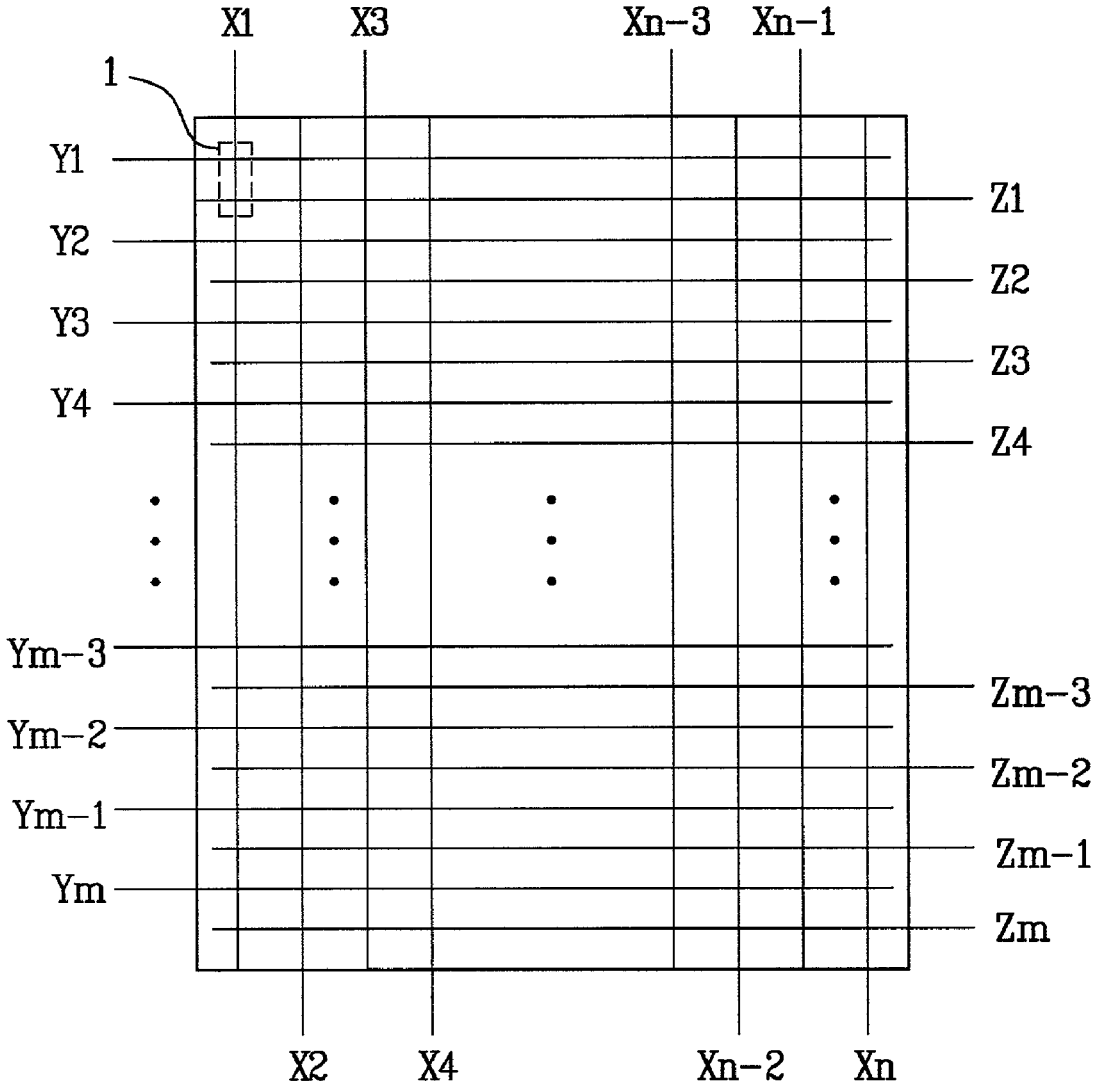
FIG. 2 Related Art
FIG. 2 illustrates an overall electrode arrangement of a PDP having the discharge cell of FIG. 1.
Figure 3:
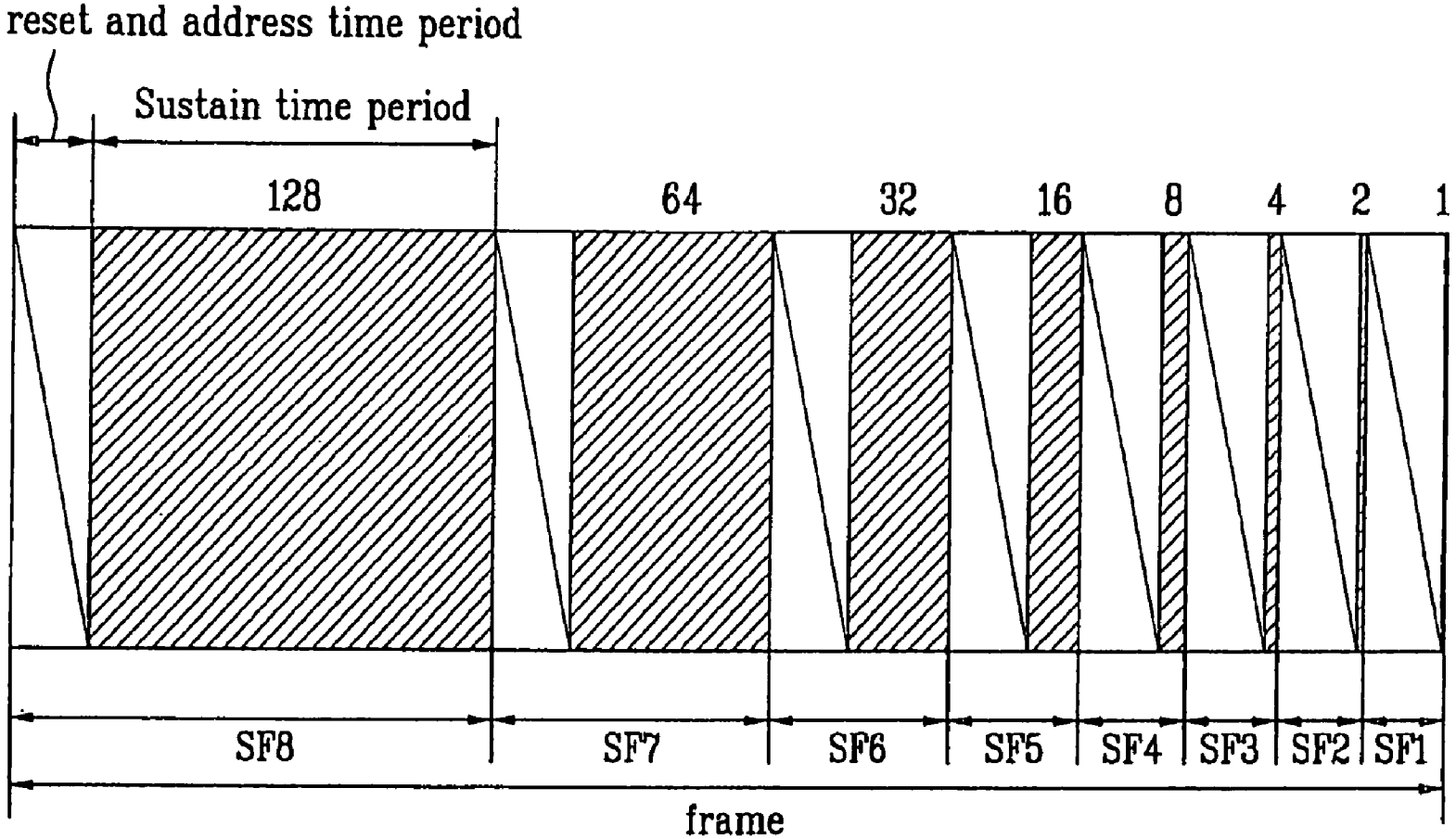
FIG. 3 RELATED ART
FIG. 3 illustrates a structure of one frame for explaining a related art method for driving sub-fields.
Figure 4:
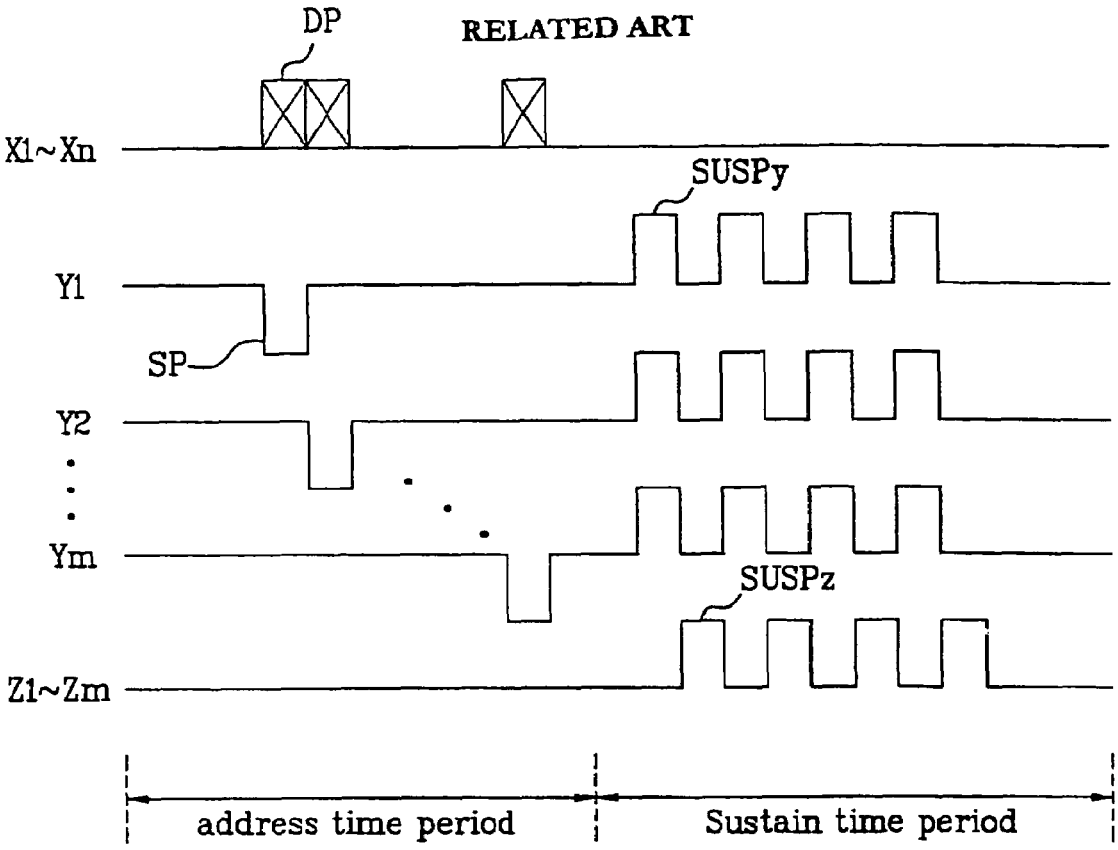
FIG. 4 RELATED ART
FIG. 4 illustrates waveforms representing a related art method for driving a PDP.
Figure 5:
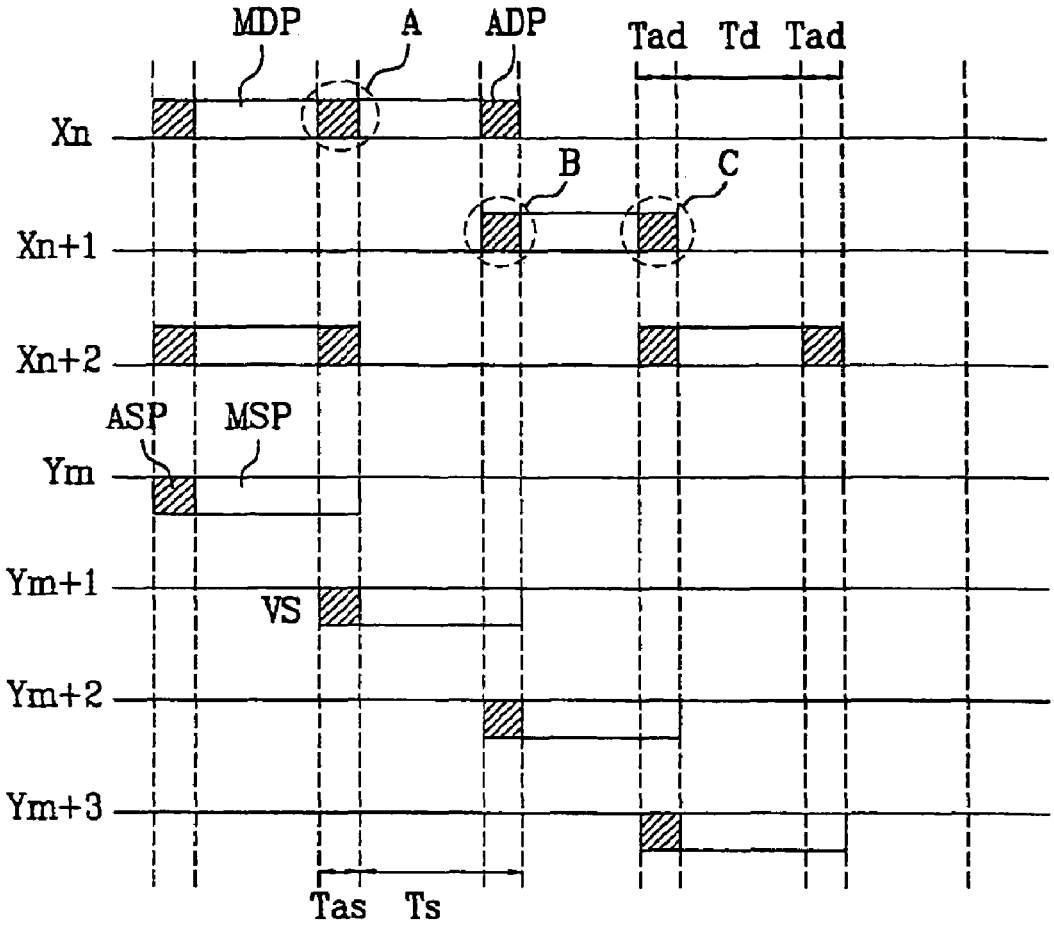
FIG. 5 RELATED ART
FIG. 5 illustrates another example of waveforms representing a related art method for driving a PDP.
Figure 6:
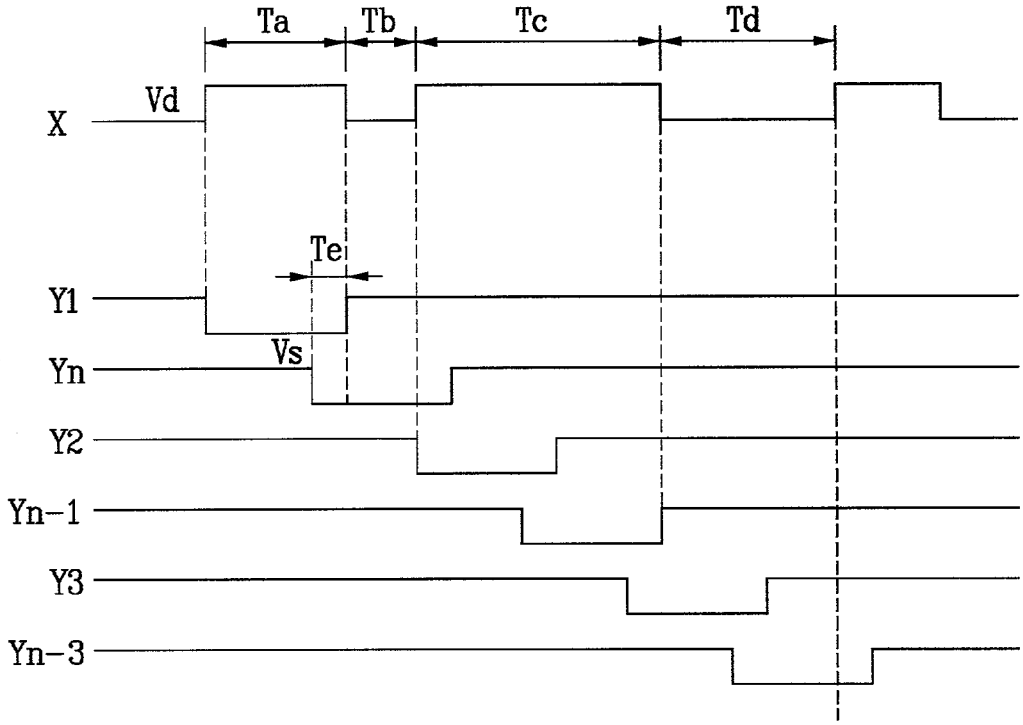
FIG. 6 illustrates waveforms representing a method for driving a PDP in accordance with a preferred embodiment of the present invention.

Reference will now be made in detail to tee preferred embodiments of the present invention, examples of which are illustrated in the accompanying drawings FIGS. 6–11. FIG. 6 illustrates waveforms representing a method for driving a PDP in accordance with a preferred embodiment of the present invention.

Referring to FIG. 6, during a first embodiment address period of the present invention, scanning pulses Vs are progressively supplied to scanning/sustaining electrode lines Y, and data pulses Vd are supplied to address electrode lines X synchronous to the scanning pulses Vs supplied to the scanning/sustaining lines Y, to cause address discharges.

Figure 7:
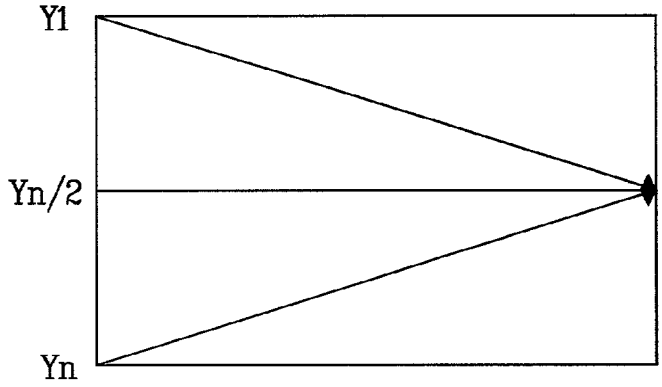
FIG. 7 illustrates waveforms representing a method for scanning a PDP in accordance with a preferred embodiment of the present invention.

In this instance, referring to FIG. 7, the scanning/sustain electrode lines Y are divided into two blocks in the scanning progressed starting from a first scanning/sustain electrode line Y of an upper half block and a last scanning/sustain electrode lines Y of a lower half block, with the scanning pulses Vs supplied to respective scanning/sustain electrode lines made to be overlapped for a preset time period (for an example, 0.3 μs) to each other.

The address time period in accordance with a first preferred embodiment of the present invention will be explained, in detail.

After the scanning pulse Vs is supplied to the first scanning/sustain electrode line Y1, the scanning pulse Vs is supplied to an (n)th scanning/sustain electrode line Yn. In this instance, the scanning pulse Vs supplied to the (n)th scanning/sustain electrode line Yn is overlapped with the scanning pulse Vs supplied to the first scanning/sustain electrode line Y1 as much as a preset time period (0.3 μs).

If the scanning/sustain electrode lines are divided into two blocks in the driving of the scanning/sustain electrode lines, the scanning pulses Vs can be applied to the scanning/sustain electrode lines with the scanning pulses overlapped with each other, without any change of the scanning/sustain driving part.

In the meantime, if a data signal with a logic value '1' is supplied to the address electrode line X, a data pulse Vd having a minute width Ta, for an example, in a range of 1.4 μs, is generated. The pulse widths of the scanning pulse Vs supplied to the scanning/sustain electrode line Y and the data pulse Vd supplied to the address electrode line X are identical.

If the data signal with a iogic value '0' is supplied to the address electrode line X, the data pulse Vd having a minute width Tb smaller than the width Ta of the data pulse with a logic value '1', for an example, in a range of 0.8 μs, is generated. If the data signal with a logic value '1' are supplied to the address electrode lines X continuously, a data pulse Vd with a pulse width Tc in a range of 2.5μs is applied to the address electrode line X. That is, the pulse width Tc of the data pulse Vd when the data signal with a logic value '1' is supplied to the address electrode line X has a pulse width of two times of a pulse width 1.4 μs of the data pulse Vd with a logic value '1' minus the overlapped time period 0.3 μs of the scanning pulses Vs.

When a data signal with a logic value '0' is supplied to the address electrode line X continuously, a width Td of data pulse Vd supplied to the address electrode line X is in a range of 1.9 μs. That is, the pulse width Td of the data pulse Vd when the data signal with a logic value '0' is supplied to the address electrode line X has a pulse width of two times of a pulse width 1.6 μs of the data pulse Vd with a logic value '0' plus the overlapped time period 0.3 μs of the scanning pulses Vs.

Figure 8:
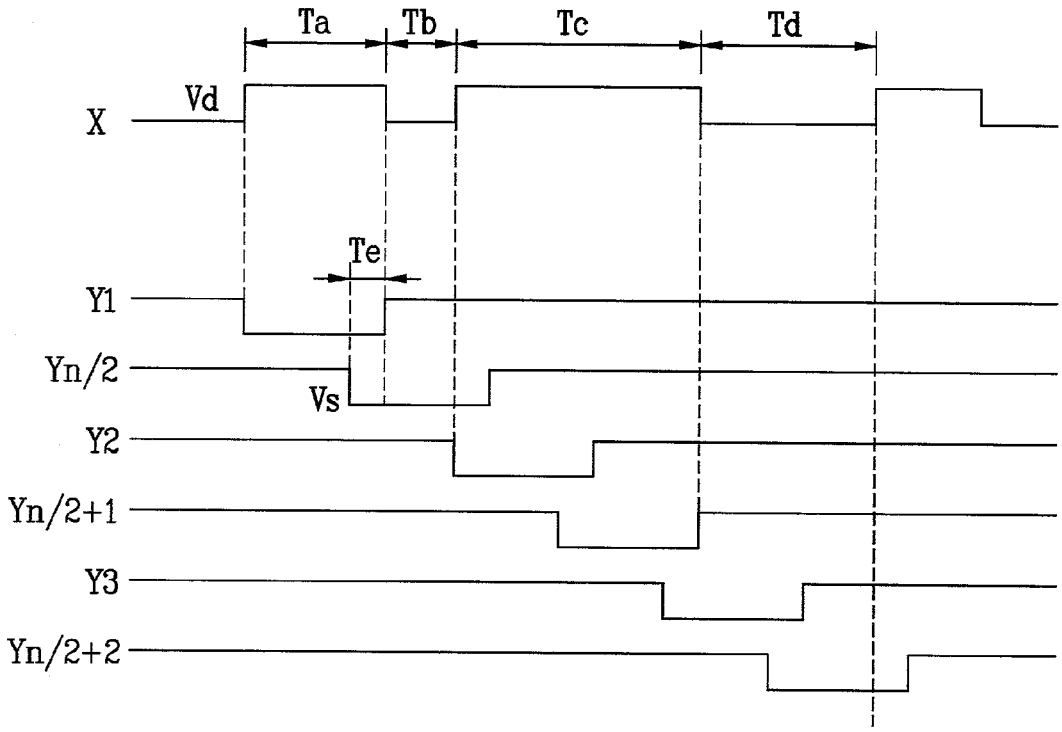
FIG. 8 illustrates waveforms representing a method for driving a PDP in accordance with another preferred embodiment of the present invention.
Figure 9:
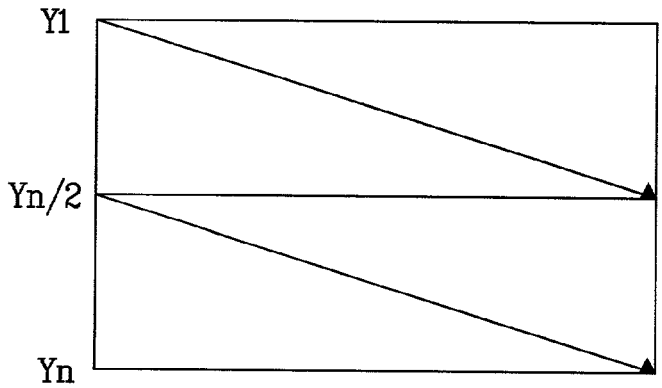
FIG. 9 illustrates waveforms representing a method for scanning a PDP in accordance with another preferred embodiment of the present invention.

A scanning process of the scanning/sustain electrode lines Y in accordance with a second preferred embodiment of the present invention is set as shown in FIGS. 8 and 9. That is, a scanning pulse Vs is supplied to a first scanning/sustain electrode line Y1, the scanning pulse Vs is supplied to a (Yn/2)th scanning/sustain electrode line Yn/2 such that the two scanning lines are overlapped for a preset time period 0.3 μs, and the data pulse Vd with a logic value '1' and the data pulse Vd with a logic value '0' are applied to the address electrode line X in succession.

Operation waveforms shown in FIGS. 8 and 9 and operation waveforms shown in FIGS. 6 and 7 are different only in view of scanning process, but identical in view of operation processes and effects.

Eventually, since the data pulse width when the data signal with a logic value '0' is applied to the address electrode line X is greater than the data pulse width when the data signal with a logic value '1' is applied to the address electrode line X, an adequate discharge time period can be secured. Moreover, by overlapping the scanning pulse Vs supplied to the scanning/sustain electrode line Y, an adequate address time period can be secured.

Figure 10:
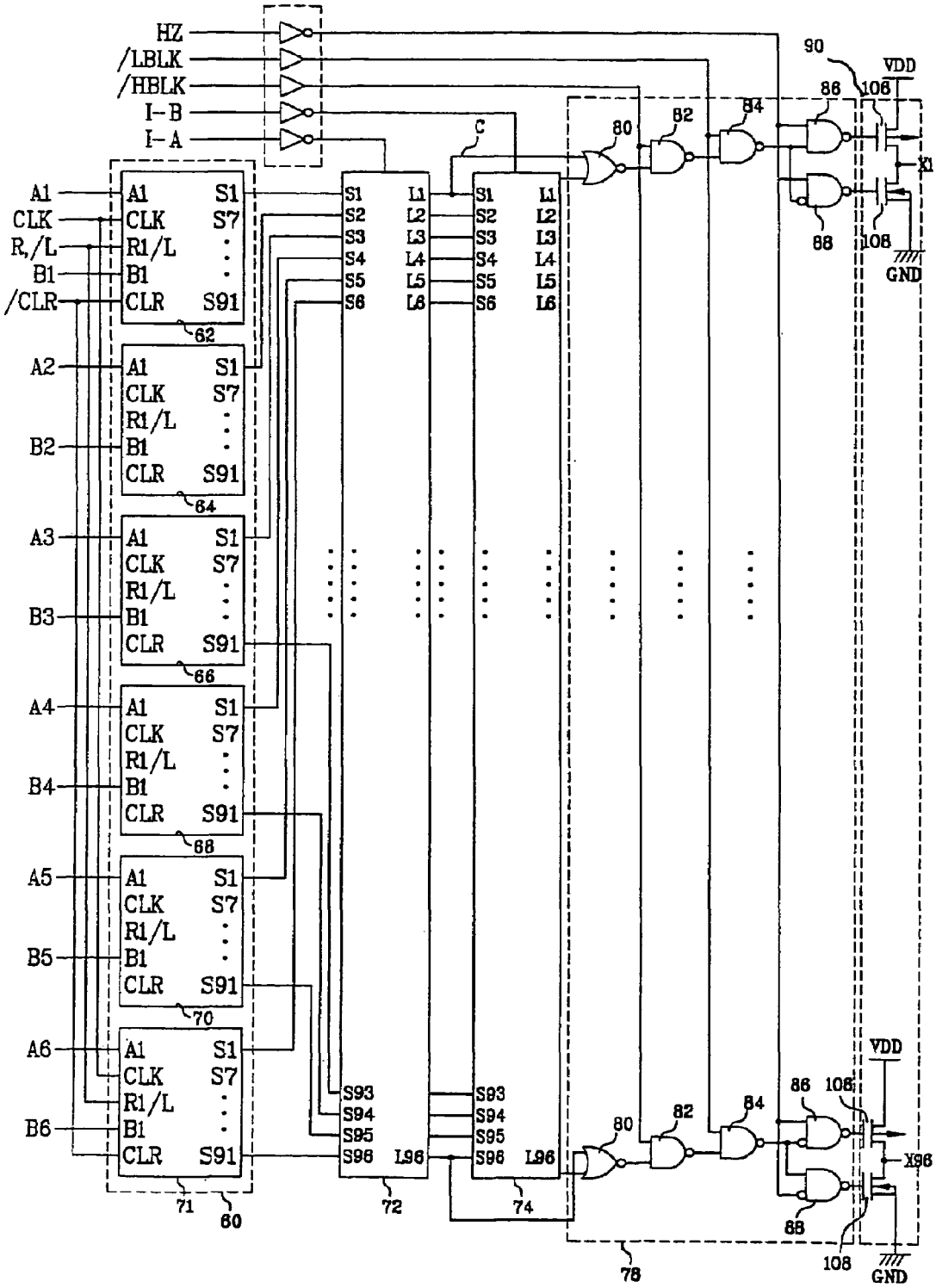
FIG. 10 illustrates a circuit of an address electrode driving part in accordance with a preferred embodiment of the present invention; and, FIG. 11 illustrates waveforms representing an operation of the address electrode driving part in FIG. 10.

FIG. 10 illustrates a circuit of an address electrode driving part in accordance with a preferred embodiment of the present invention.

Referring to FIG. 10, the address electrode driving part in accordance with a preferred embodiment of the present invention includes data receiving means 60 for receiving a video data, a first latch 72 for receiving the video data from the data receiving means 60, a second latch 74 for receiving the video data from the first latch 72, a control signal generating part for receiving the video data stored in the first and second latches 72 and 74 and generating a control signal, and a forwarding part 90 for providing a data pulse Vd to the address electrode line X in response to the control signal from the control signal generating part 78.

The data receiving means 60 includes a plurality of shift registers 62, 64, 66, 68, 70, and 71 each having data receiving terminals A, and B for receiving data, a clock terminal CLK for receiving a clock signal, a control terminal R/L for determining a shift direction of the data, and a clear terminal CLR for resetting a received data.

The control signal generating part 78 includes a plurality of NAND and NOR gates 80, 82, 84, 86, and 88, and the forwarding part 90 includes a plurality of switching devices 106 and 108 each connected between the power source VDD and a ground terminal GND. The plurality of switching devices 106 and 108 are operative by the control signal from the control signal generating part 78.

The address electrode driving part is made to be operative grouped into odd numbered lines and even numbered lines, to take location thereof in an upper part or a lower part of the PDP.

Therefore, according to a location of fitting of the address electrode driving part, a direction of data reception and shift sequence are required to be set, differently. For an example, if a data is received at the 'A' terminal, the control terminal R/L receives a low reception signal. In this instance, the data received at the 'A' reception terminal is transferred to the 'B' reception terminal synchronous to the clock signal received at the clock terminal CLK.

If the data is received at the 'B' terminal, the control terminal R/L receives a high reception signal. In this instance, the data received at the 'B' reception terminal is transferred to the 'A' reception terminal synchronous to the clock signal received at the clock terminal CLK.

When the clear terminal CLR receives a low reception signal, the shift register 62, 64, 66, 68, 70, or 71 resets to an initial value, and forwards a video data of a preset bits stored in the shift register 62, 64, 66, 68, 70, or 71 to the first latch 72.

Figure 11:
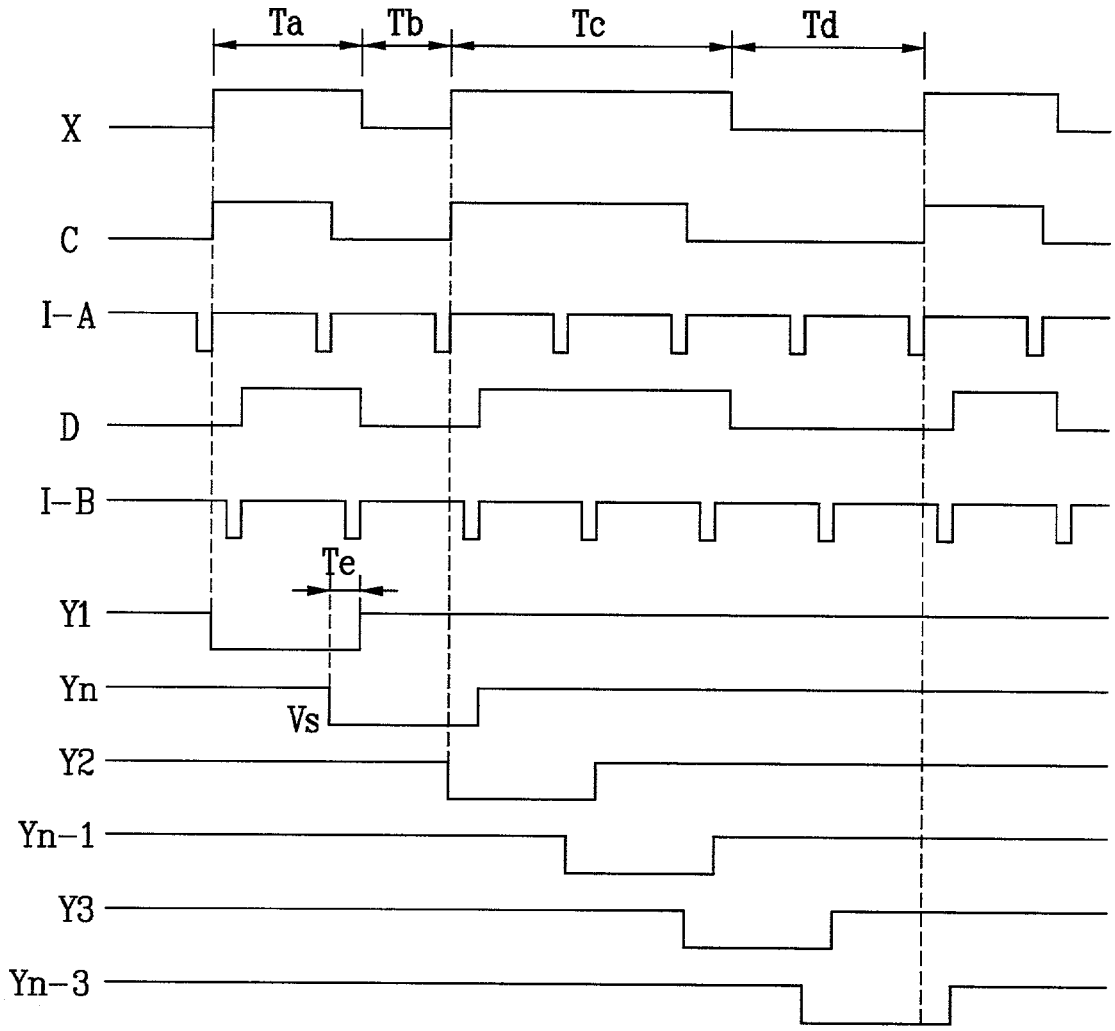

When a pulse signal as shown in FIG. 11 is applied to an 1_A terminal of the first latch 72, the first latch 72 supplies a stored video data to the control signal generating part 78 and the second latch 74 synchronous to the pulse signal. That is, a 'C' waveform shown in FIG. 11 is supplied to the control signal generating part 78 and the second latch 74.

The second latch 74 receives a pulse signal delayed for a time period from the supplied pulse signal at an 1_B terminal thereof. Then, the second latch 74 supplies the video data stored therein to the control signal generating part 78 synchronous to the pulse signal received at the 1_B terminal. That is, a 'D' waveform in FIG. 11 is supplied to the control signal generating part 78.

In the control signal generating part 78, an NOR gate 80 provides a low signal when a data is received from at least one of the first latch 72 and the second latch 74, and a low signal from the NOR gate 80 and a /HBLK signal are provided to a first NAND gate 82. The /HBLK signal is low when it is intended to receive high signals at all the address electrode lines X, and high in the other cases. Such a /HBLK signal is used when it is intended to supply high signals to all address electrode lines 'X' except the addressing time period.

The first NAND gate 82, having a high signal from the /HBLK and a low signal received from the NOR gate 80, forwards a high signal to a second NAND gate, and the second NAND gate 84 receives an output signal of the first NAND gate 82 and a /LBLK signal.

The /LBLK signal is low when it is intended to receive a low signal at all address electrode lines, and is high in the other cases. The /LBLK is used when it is intended to supply a low signal to all the address electrode lines X except the addressing time period.

The second NAND gate 84, having a high signal from the /LBLK and a high signal received from the first NAND gate 82, forwards a low signal to third and fourth NAND gates 86 and 88, and both the third and fourth NAND gates 86 and 88 receive an output signal of the second NAND gate 84 and an HZ signal. The HZ signal is high when it is intended to put all the address electrode lines into high impedance states, and low in the other cases.

The third NAND gate 86, having a low signal from the HZ signal and a high signal received from the second NAND gate 84, supplies a high control signal to the forwarding part 90, and the fourth NAND gate 88, having a low signal from the HZ signal and a low signal received from the second NAND gate 84, forwards a high control signal to the forwarding part 90.

The second switching device 108 of an N type channel, having a high signal received from the fourth NAND gate 88, can not be turned on, but the first switching device 106 of a P type channel, having a high signal received from the third NAND gate 86, only is turned on, to supply a data pulse of logic '1' to the address electrode line.

In other words, when a low signal is supplied from the NOR gate 80, the data pulse is supplied to the address electrode line X, and when a high signal is supplied from the NOR gate 80, no data pulse is supplied to the address electrode line X. At the end, the data pulse with a logic value '0' is supplied to the address electrode line X only when a low signal is provided from the first latch 72 and the second latch 74.

Table 1 shows values of various signals supplied to the control signal generating part 78 and output signals provided therefrom according to the values of various signals supplied thereto.

TABLE 1

| A(B) | /HBLK | /BLK | HZ | Output |
|---|---|---|---|---|
| X | L | H | L | H |
| X | X | L | L | L |
| X | X | X | HZ | High impedance |
| L | H | H | L | L |
| H | H | H | L | H |

As has been explained, the device and method for driving a plasma display panel of the present invention has the following advantages.

First, the different pulse widths of the data pulses set for logic values '0' and '1' to be applied to the address electrode lines facilitates a fast addressing.

Second, the generation of the data pulses with different pulse widths set for logic values '0' and '1' without additional switch permits to minimize power consumption.

Third, the overlapping of scanning pulses for a preset time period, causing to flow an adequate discharge current to the scanning/sustain electrode line in an address discharge, by dividing the scanning/sustain electrode lines into more than two or more blocks in driving the scanning/sustain electrode line permits to prevents mis-writing and mal-discharge.

It will be apparent to those skilled in the art that various modifications and variations can be made in the device and method for driving a plasma display panel of the present invention without departing from the spirit or scope of the invention. Thus, it is intended that the present invention cover the modifications and variations of this invention provided they come within the scope of the appended claims and their equivalents.

What is claimed is:

1. A method for driving a plasma display panel having a matrix of a plurality of discharge cells formed by a plurality of scanning/sustain electrode lines and a common sustain electrode line in parallel, and a plurality of address electrode lines crossed with the scanning/sustain electrode lines and the common sustain electrode line, comprising the steps of:

(a) discharging, and initializing the plurality of discharge cells;

(b) generating a plurality of data pulses based on input data signals and applying the plurality of data pulses to the address electrode lines, a width of each of the plurality of data pulses being based on a logic value of at least one of the input data signals, wherein if a first one of the input data signals has a first logic value then the width of a corresponding one of the data pulses is a first data pulse width and if a second one of the input data signals has a second logic value then the width of a corresponding one of the data pulses is a second data pulse width, and if two consecutive input data signals have the first logic value then the width of a corresponding one of the data pulses is a third data pulse width, wherein said first logic value is different from said second logic value, the first data pulse width is greater than the second data pulse width, and the third data pulse width is different than the first data pulse width and the second data pulse width; and (c) applying scanning pulses having a pulse width identical to the first data pulse width, wherein the scanning pulses progressively applied to the plurality of scanning/sustain electrode lines are overlapped for a preset time with respect to each other.

2. A method as claimed in claim 1, wherein the plurality of scanning/sustain electrode lines are divided into two or more than two blocks, and the scanning pulses are separately applied to the divided blocks.

3. A method as claimed in claim 2, wherein the plurality of scanning/sustain electrode lines are divided into an upper part and a lower part, and the scanning pulses are progressively applied to the upper part starting from a first scanning/sustain electrode line, and the scanning pulses are progressively applied to the lower part starting from a last scanning/sustain electrode line.

4. A method as claimed in claim 1, wherein the plurality of scanning/sustain electrode lines are divided into an upper part and a lower part, and the scanning pulses are progressively applied to each of the divided blocks starting from a first scanning/sustain electrode line.

5. The method as claimed in claim 1, wherein when said input data signals are supplied N consecutive times to one of the address electrode lines at the first logic value, another data pulse width is a pulse width of N times the first data pulse width minus the overlapped time period of the scanning pulses.

6. The method as claimed in claim 1, wherein when said input data signals are supplied N consecutive times to one of the address electrode lines at the second logic value, another data pulse width is a pulse width of N times the second data pulse width plus the overlapped time period of the scanning pulses.

7. A method for driving a plasma display panel having a plurality of discharge cells formed by a plurality of scanning/sustain electrode lines and a common sustain electrode line, and a plurality of address electrode lines traversing the scanning/sustain electrode lines and the common sustain electrode line, the method comprising:

generating a plurality of data pulses based on input data signals and applying the plurality of data pulses to the address electrode lines, a width of each of the plurality of data pulses being based on a logic value of at least one of the input data signals, wherein if a first one of the input data signals has a first logic value then the width of a corresponding one of the data pulses is a first data pulse width and if a second one of the input data signals has a second logic value then the width of a corresponding one of the data pulses is a second data pulse width, and if two consecutive input data signals have the first logic value then the width of a corresponding one of the data pulses is a third data pulse width, wherein said first logic value is different from said second logic value, the first data pulse width is greater than the second data pulse width, and the third data pulse width is different than the first data pulse width and the second data pulse width; and applying scanning pulses having a pulse width substantially identical to the first pulse width, a first one of the scanning pulses applied to a first one of the plurality of scanning/sustain electrode lines being overlapped for a preset time as compared to a second one of the scanning pulses applied to a second one of the plurality of scanning/sustain electrode lines.

8. A method as claimed in claim 7, wherein a third one of the scanning pulses applied to a third one of the plurality of scanning/sustain electrode lines being overlapped for the preset time as compared to a fourth one of the scanning pulses applied to a fourth one of the plurality of scanning/sustain electrode lines.

9. A method as claimed in claim 7, further comprising discharging and initializing the plurality of discharge cells.

10. A method as claimed in claim 7, wherein the first logic value and the second logic value are '1' and '0', respectively.

11. A method as claimed in claim 7, wherein the plurality of scanning/sustain electrode lines are divided into at least two blocks, and the scanning pulses are separately applied to the divided blocks.

12. A method as claimed in claim 11, wherein the plurality of scanning/sustain electrode lines are divided into an upper part and a lower part, and the scanning pulses are progressively applied to each of the divided blocks starting from the first scanning/sustain electrode line.

13. A method as claimed in claim 7, wherein the plurality of scanning/sustain electrode lines are divided into an upper part and a lower part, and the scanning pulses are progressively applied to the upper part starting from the first scanning/sustain electrode line, and the scanning pulses are progressively applied to the lower part starting from a last scanning/sustain electrode line.

14. The method as claimed in claim 7, wherein when said input data signals are supplied N consecutive times to one of the address electrode lines at the first logic value, another data pulse width is a pulse width of N times the first data pulse width minus the overlapped time period of the scanning pulses.

15. The method as claimed in claim 7, wherein when said input data signals are supplied N consecutive times to one of the address electrode lines at the second logic value, another pulse width is a pulse width of N times the second pulse width plus the overlapped time period of the scanning pulses.

* * * * *